US005346169A

United States Patent [19]

Polonsky

[11] Patent Number: 5,346,169

[45] Date of Patent: Sep. 13, 1994

[54] SUPPORT BRACKET

[76] Inventor: Eli Polonsky, 1608 S. Kenton St., Aurora, Colo. 80012

[21] Appl. No.: 27,798

[22] Filed: Mar. 8, 1993

[51] Int. Cl.[5] ..... F16M 13/00

[52] U.S. Cl. ..... 248/547; 248/224.3; 248/225.1

[58] Field of Search ..... 248/547, 223.4, 224.1, 248/224.2, 224.3, 225.1; 211/87

[56] References Cited

U.S. PATENT DOCUMENTS

| | | | |
|---|---|---|---|
| 1,127,596 | 2/1915 | Crabiel | 248/224.2 X |
| 1,569,278 | 1/1926 | Hickman | 248/224.3 |
| 1,842,786 | 1/1932 | Kirsch | 248/225.1 X |
| 2,288,439 | 6/1942 | Dahm | 248/547 |
| 2,490,854 | 12/1949 | Bozoti | 248/224.3 |
| 4,911,396 | 3/1990 | Polonsky | 248/547 |
| 4,979,713 | 12/1990 | Bell | 248/224.3 |
| 5,035,389 | 7/1991 | Wang | 248/224.1 |
| 5,060,898 | 10/1991 | Chang | 248/224.1 |

FOREIGN PATENT DOCUMENTS

| | | | |
|---|---|---|---|
| 1253392 | 11/1971 | United Kingdom | 248/224.3 |

*Primary Examiner*—J. Franklin Foss
*Attorney, Agent, or Firm*—Aquilino and Welsh

[57] ABSTRACT

A hanger bracket to be secured to a support surface for supporting an article to be hung, formed and method of making the same. The bracket is a two-piece structure including a base having a plurality of elongated slots formed in the base, which are formed into channels by permanently securing a cover over the base. Elongated fastener nails extend through the channels at an angle into a support surface for mounting the support bracket. Attachments are disclosed for mounting various items to the support surface.

5 Claims, 3 Drawing Sheets

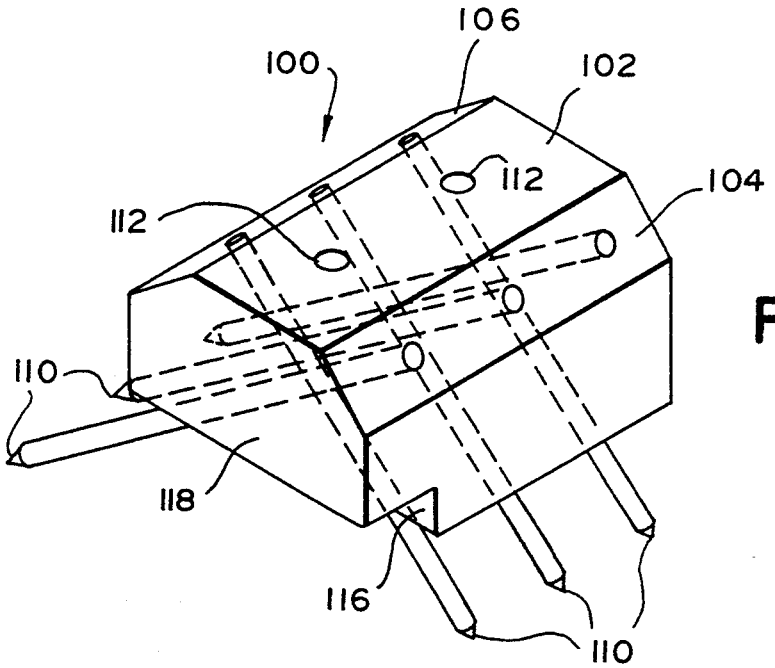
FIG. 5
FIG. 6
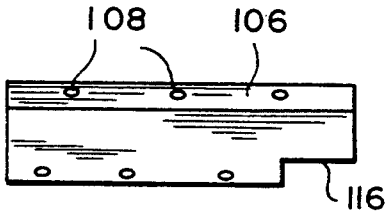
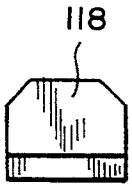
FIG. 9
FIG. 7
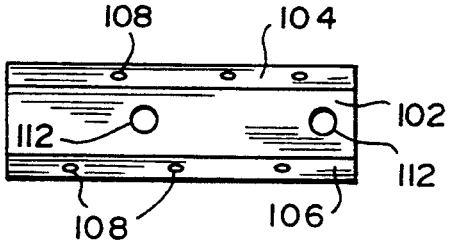
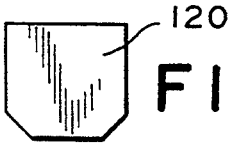
FIG. 10
FIG. 8
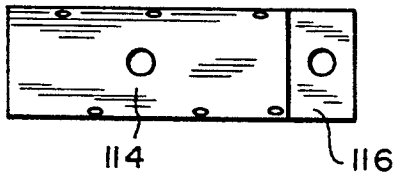

SUPPORT BRACKET

BACKGROUND AND SUMMARY OF THE INVENTION

The present invention relates to an improved support fixture, and in particular, to a bracket adapted to be attached to wall or ceiling surfaces, such as acoustical tile, wallboard and other surfaces which do not provide adequate support for nails, screws or other fasteners.

The present invention represents an improvement over my U.S. Pat. No. 4,911,396. As described in the previous patent, conventional brackets used to support materials from wall or ceiling surfaces normally use a single supporting nail combined with some type of load device to more equally distribute the weight on the supporting surface. However, when supporting large or bulky items, it is normally necessary to use wall anchors or other similar wall load bearing brackets because of the relative weakness of the tile or plasterboard supporting surface. These types of anchors require holes to be predrilled into the surface, and require that the wall anchor be permanently secured in place. Removal of these types of brackets can only be done by destroying a part of the supporting surface, requiring subsequent repair.

The hanger bracket disclosed in U.S. Pat. No. 4,911,396 represents an improvement over the known prior art devices, and includes a support base having an angularly disposed wall and a cover having a complimentary angular wall surface for gripping fasteners between the support and the cover to maintain the fasteners in place and at an angle with respect to the support surface, whereby driving the fasteners into the support surface which securely holds the hanger bracket in place. An attachment such as a hook or other support device is connected to the bracket, permitting the hanging materials to be supported. If it becomes necessary to remove the bracket from the support surface, it can be easily done without destroying the support. The cover is removed, exposing the fasteners, which are pulled from the support surface using pliers or similar tool, leaving only small angular holes, which can be easily repaired.

The present invention is directed to an improvement of the hanger bracket shown in U.S. Pat. No. 4,911,396. A first embodiment includes a base member having a frustro-conical outer surface with a plurality of slots integrally molded therein. A cover member includes an inner frustro-conical surface corresponding to the frustro-conical surface of the base. The cover is welded or otherwise secured to the base which closes the slots, creating a plurality of closed channels formed at an angular relationship to the support surface. A plurality of fastener nails or the like are inserted into the channels through the bracket and angularly enter a support surface, thereby securing the bracket in place. The base includes a centrally located threaded hole to receive a hook or similar supporting member, which may be screwed therein for supporting the materials to be hung.

The bracket may be used in combination with an outer cover having an inner well which locates the outer cover around the support bracket. When the outer cover is used, it is placed over the bracket before the hook is connected.

A second embodiment of the support bracket in the form of a generally rectangular element, having at least two angular surfaces and a plurality of angularly displaced holes in the angular surfaces which receive nail fasteners in order to attach the support to a support surface. One end of the support bracket is notched, which forms an integral hook, or attachment member, if the support is used by itself. When an outer cover is used, the outer cover well includes a slot to accommodate one end of the rectangular support to prevent the outer cover from turning when the support is in place on a support surface.

In both of the support bracket embodiments, fasteners are driven into the supporting surface at an angle, making it relatively impossible for the support to be pulled free when a weight, such as a picture frame, flower pot, or other weighted device, is hung from the support surface.

Among the objects of the present invention are the provision of a support bracket for supporting objects from either a ceiling or wall support surface.

Another object is the provision of a support bracket integrally formed with a plurality of angular channels for attachment of fasteners to a support surface.

Still another object of the present invention is the provision of a support bracket, which uses small sized fasteners which can be removed without permanently damaging the supporting surface.

Still another object of the present invention is the provision of a support bracket which may be mounted with simple tools and mounting techniques.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 5 is a perspective view of a second embodiment of a support bracket in accordance with the present invention.

FIG. 6 is a side elevational view of the bracket of FIG. 5.

FIG. 7 is a top plan view of the bracket of FIG. 5.

FIG. 8 is a bottom view of the bracket of FIG. 5.

FIG. 9 is an end elevational view of the bracket of FIG. 5.

FIG. 10 is an end elevational view taken from the opposite end of FIG. 9.

DESCRIPTION OF THE PREFERRED EMBODIMENTS

Figure 1:
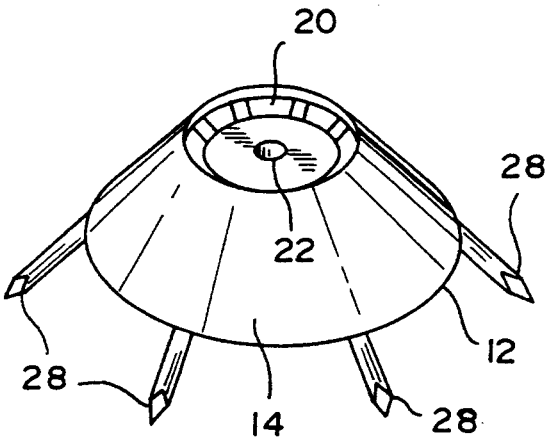
FIG. 1 is a perspective view of a first embodiment of a support bracket in accordance with the subject invention.
Figure 2:
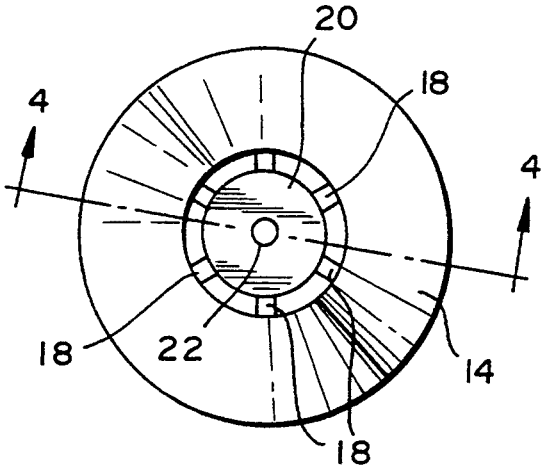
FIG. 2 is a top plan view thereof.
Figure 3:
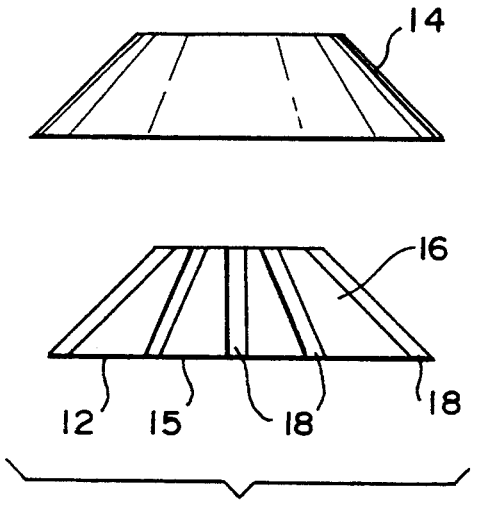
FIG. 3 is an exploded view of the base and cover of the support bracket of FIG. 1.
Figure 4:
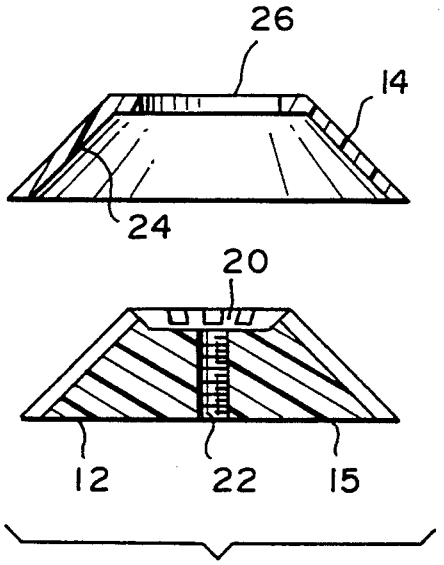
FIG. 4 is a sectional view thereof taken along lines 4—4 of FIG. 2.

A first embodiment of a hanger bracket 10 in accordance with the present invention is illustrated in FIGS. 1–4. The bracket is formed of a base 12 and a cover 14. The base 12 includes a frustro-conical top surface 16 having a series of equally spaced slots 18 thereon. The center portion of the base 12 forms a well 20 so the ends of the slots 18 are open. A threaded hole 22 is formed directly in the center of the base 12 for attachment of a hook or other fastener devices as will be described hereinbelow. The underside 15 of the base may be solid or formed in any other rigid configuration. The cover 14 has an interior surface 24 which is frustro-conical in shape and conforms to the top surface 16 of the base 12. The cover 14 is formed with a central opening 26 to provide access to the well 20 in the base 12. When the cover 14 is in place over the base 12, the longitudinal opening along the length of the tops of each slot 18 is closed, forming a series of elongated channels extending parallel to the frustro conical top surface 16 at an angle to the flat underside of the base 12. The channels 18 are accessible through the opening 26 in the cover and the well 20 formed in the base to receive a number of fasteners 28, such as nails. The fasteners extend through the base at an angle a sufficient distance for securing the bracket 10 onto a support surface.

The base 12 and the cover 14 are formed as two separate pieces in order to mold the slots in the angular base. This enables the bracket 10 to be made of high strength plastic and eliminates difficulties which are encountered when the holes for the fasteners have to be drilled.

The base 12 and cover 14 are ultrasonically welded, glued or otherwise fastened together to form a single unit to receive and position the fasteners. When the bracket 10 is secured to a support surface, such as a wall or ceiling, it will be appreciated that the nails are driven through the slots 18 into the support surface at an angle. Because of the angular position of the fastener nails relative to the support surface, a vector force is created perpendicular to the gravity force of an item supported by the bracket 10, thus preventing the fastener nails 26 from being pulled free. The bracket 10 is ideally suited for use with plasterboard walls and ceilings and/or acoustical tiles used in dropped ceilings where the strength of the support surface is limited by the material it is made of and where fasteners have a tendency to pull out when positioned perpendicular to the support surface.

After the bracket 10 is secured to the support surface, the heads of the fastener nails are accessible so they may be removed simply by pulling them out with pliers or a similar gripping tool. This is easily accomplished since wallboard or ceiling tile support surfaces exhibit little resistance to removal of the nails if the removal force is applied perpendicular to the surface. Once the bracket is removed, there is little permanent damage to the support surface, usually only nail holes which may be easily patched or covered. In addition, the bracket 10 may be reused in another location without any loss of effectiveness, since there is no damage to the bracket when it is removed.

FIGS. 5–10 illustrate a second embodiment of a hanger bracket 100, which is generally rectangular in shape and includes a bottom surface 101, a top surface 102, side surfaces 103 and end surfaces 118. The top surface 102 includes a centrally disposed planar portion parallel to the bottom surface 101 and perpendicular to the side surfaces 103. Two sloped angular surfaces, 104 and 106, are each disposed at approximately a 45° angle with respect to the top surface 102, and are located between the centrally disposed portion of the top surface and the side surfaces. A plurality of holes 108 are drilled perpendicular to the slope surfaces 104 and 106 and are bored completely through the bracket 100. As can be seen in the perspective view of FIG. 5, the holes 108 accommodate a series of elongated fastener nails 110, which extend completely through the bracket and emerge on the opposite side thereof at a 45° angle. The bracket is also provided with mounting holes 112, which are formed perpendicular to the top surface 102. The bottom 114 is provided with a notch 116 adjacent one end 118 of the bracket. The opposite end 120 is planar in shape.

Figure 11:
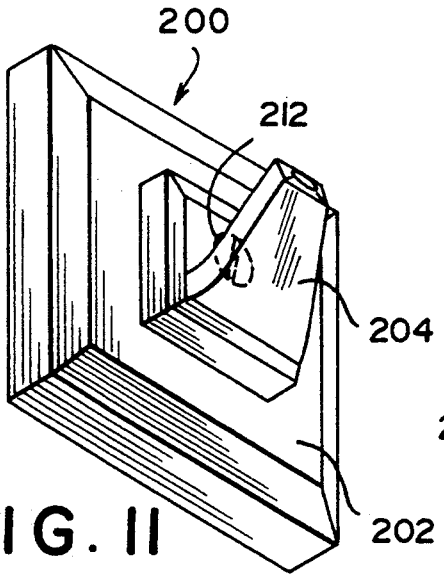
FIG. 11 is a perspective view of the first embodiment of the support bracket including a cover and a hook.
Figure 12:
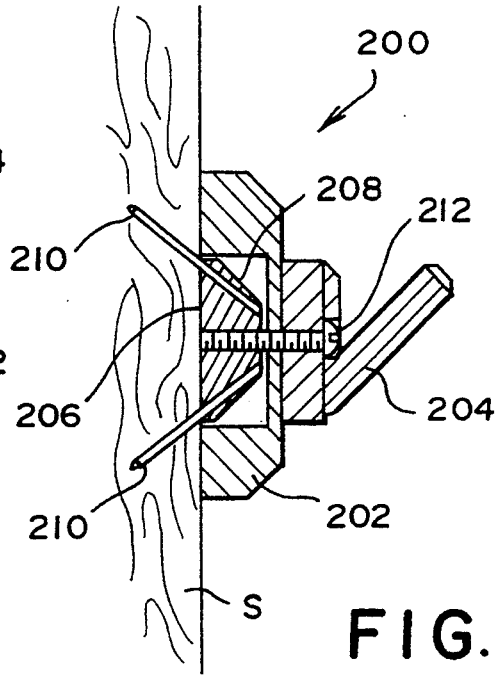
FIG. 12 is a sectional view taken along lines 12—12 of FIG. 11.

FIGS. 11 and 12 show a support bracket 200, including a cover 202 and hook 204 secured to a support surface S. It will be appreciated that the bracket 200 includes a base 206 and interior cover 208 of the same type as described in FIGS. 1–4. A plurality of fasteners 210 are angularly positioned within the support surface to maintain the bracket in place when a load is carried on the hook 204. The hook 204 is secured to the bracket base 206 by means of a threaded fastener 212, which passes through the hook 204 to cover 202 and screws directly into the base 206.

Figure 13:
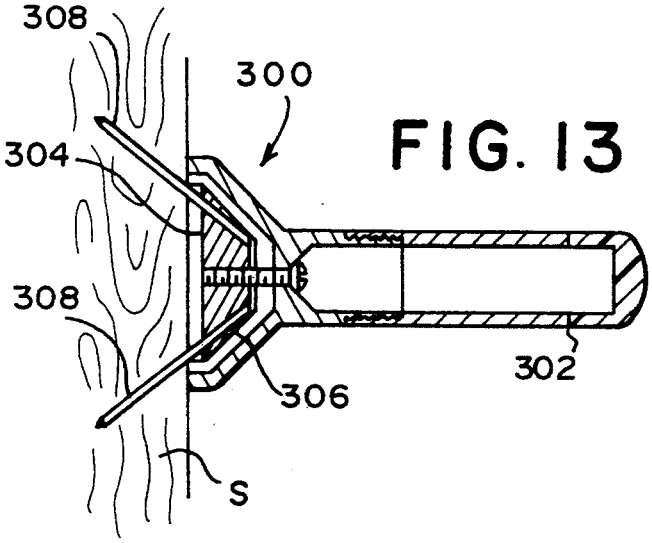
FIG. 13 is a sectional view of the first embodiment of the support bracket used to support a doorstop.

FIG. 13 shows an alternate use of the support bracket 300 of the present invention for supporting a member such as a door stop 302. It will be appreciated that the base 304, cover 306 and a plurality of angularly disposed fastener nails 208 are the same bracket as shown in FIGS. 1–4 and also in FIG. 12.

Figure 14:
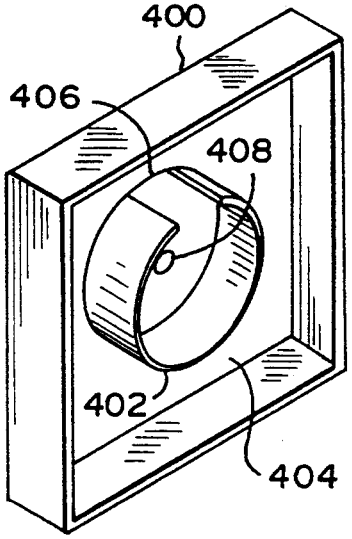
FIG. 14 is a bottom perspective view of an outer cover used with the support bracket of the present invention.

FIG. 14 shows an inside perspective view of an embodiment of a cover 400 used with the bracket of the present invention. The cover 400 includes a circular wall 402 integrally molded with the bottom underside 404 of the cover. The wall includes a slot 406. A hole 408 accommodates a suitable fastener. Preferably the circular wall 402 is sized to precisely fit a circular support bracket of the type shown in FIGS. 1–4. This centers the cover 400 and also provides additional stability to the entire bracket structure. When this cover is used with a rectangular bracket of the type shown in FIGS. 5–10, the bracket extends through the slot 406, which prevents the cover from turning with respect to the bracket.

Figure 15:
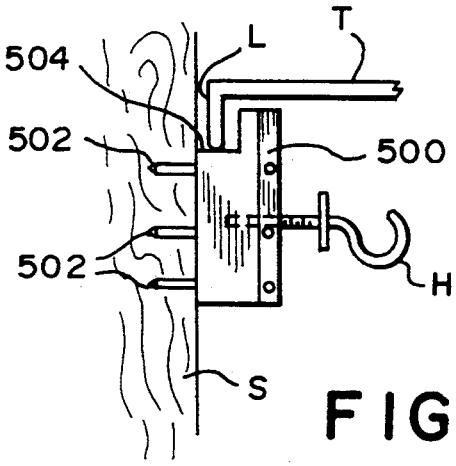
FIG. 15 is a view of the second embodiment of the support bracket attached to a support surface.

FIG. 15 shows a support bracket 500 of the type shown and described with respect to FIGS. 5–10. The bracket 500 is secured to a support surface S by means of a plurality of angularly disposed fastener nails 502. The upper part of the bracket 500 includes a notch 504 which supports the lip L of a tray T, such as a shelf or similar planar surface. The bracket 500 may also support a hook H using a threaded fastener which is connected to a mounting hole.

A wide variety of various utility items, including shelf brackets, picture frames, potted plants and such may be supported from the bracket of the present invention. It will be appreciated that other modifications may be made in the structure in keeping within the scope of the present invention, as defined in the following claims.

I claim:

1. A hanger bracket to be secured to a support surface for supporting an article to be hung, comprising:

a base member including a frustro-conical side wall surface disposed at an angle with respect to said support surface, said base member including a plurality of upwardly opening elongated slots formed in said frustro-conical side wall surface;

a cover for covering said base member; said cover including a centrally disposed opening and interior frustro-conical wall surface complimentary to the base member frustro-conical side wall surface;

said cover being permanently attached to said base member, said interior wall surface of said cover covering said upwardly opening elongated slots, forming elongated channels between said base member and said cover, disposed at an angle to said support surface, said channels having a first end opening adjacent an upper central portion of said base member and a second end opening adjacent the lower peripheral edge of said base member;

a centrally disposed well in said base member complementary with said centrally disposed opening of said cover; said well and said opening providing access to said first end opening of each of said elongated channels;

fastener means structured to be inserted into said elongated channels and extending therethrough and outwardly at an angle from said base member for engagement with said support surface; and, attachment means for supporting weighted objects to said hanger bracket.

2. The bracket of claim 1 wherein said attachment means includes a threaded fastener and said base member includes a threaded bore to receive said attachment means.

3. The bracket of claim 1 wherein said elongated slots are equally spaced on said frustro-conical side wall surface.

4. A hanger bracket to be secured to a support surface for supporting an article to be hung, comprising:

a base member including a frustro-conical side wall surface disposed at an angle with respect to said support surface; said base member including a plurality of upwardly opening elongated slots formed in said frustro-conical side wall surface;

a centrally disposed well in a top surface of said base member;

a cover for covering said base member; said cover including a centrally disposed opening and said cover having an interior frustro-conical wall surface complimentary to the base member frustro-conical side wall surface;

said cover being permanently attached to said base member;

said interior wall surface of said cover covering said upwardly opening elongated slots, forming elongated channels between said base member and said cover, said channels disposed at an angle to said support surface;

said channels having a first end opening adjacent an upper central portion of said base member and a second end opening adjacent a lower peripheral edge of said base member;

said opening in said cover and said well in said base member providing access to said first end opening of each of said elongated channels when said cover and said base are attached.

fastener means structured to be inserted in said elongated channels through the opening in said cover and the well in said base member, said fastener means extending outwardly at an angle from said base member for engagement with said support surface; and, attachment means for supporting a weighted object to said hanger bracket; said attachment means including a threaded fastener and said base member including a threaded bore for connecting said attachment means.

5. A method of making a hanger bracket for supporting weighted objects from a support surface comprising the steps of:

forming a base member having an upwardly disposed frustro-conical wall surface at an angle with respect to a support surface;

forming a plurality of upward opening elongated slots in said frustro-conical side wall surface;

attaching a cover having an interior frustro-conical wall surface complimentary to the base member frustro-conical wall surface for covering said base member;

said cover covering said upwardly opening elongated slots, thereby forming elongated channels between an upper central portion of said base member and a lower peripheral edge of said base member;

inserting fastening means in said elongated channels whereby said fastening means extends outwardly at an angle from said base member for engagement with a support surface and securing an attachment means for supporting a weighted object to said base member.

* * * * *